US005095861A

United States Patent [19]

Dove, Jr.

[11] Patent Number: 5,095,861

[45] Date of Patent: Mar. 17, 1992

[54] ROCKER ARM BRIDGE ASSEMBLY UTILIZING SHAFT MOUNT

[76] Inventor: James E. Dove, Jr., 1034 S. Reed Rd., Grafton, Ohio 44044

[21] Appl. No.: 654,200

[22] Filed: Feb. 12, 1991

[51] Int. Cl.[5] ..... F01L 1/18

[52] U.S. Cl. ..... 123/90.39; 123/90.41; 123/193.5; 74/519; 74/559

[58] Field of Search ..... 123/90.39, 90.4, 90.41, 123/90.42, 90.44, 90.45, 90.47, 193 H; 74/519, 559

[56] References Cited

U.S. PATENT DOCUMENTS

| | | | |
|---|---|---|---|
| 3,870,024 | 3/1975 | Ridgeway | 74/519 |
| 4,438,734 | 3/1984 | Hayashi | 123/90.39 |
| 4,674,453 | 6/1987 | Dove, Jr. | 123/90.39 |
| 4,683,848 | 8/1987 | Burandt | 123/90.44 |
| 4,724,804 | 2/1988 | Wirth | 123/90.41 |
| 4,724,805 | 2/1988 | Wirth et al. | 123/90.39 |
| 4,727,832 | 3/1988 | Miyamura et al. | 123/90.39 |
| 4,748,946 | 6/1988 | Fujii et al. | 123/193 H |
| 4,949,687 | 8/1990 | Emmersberger | 123/90.4 |
| 5,005,544 | 4/1991 | Spangler | 123/193 H |

FOREIGN PATENT DOCUMENTS

| | | | |
|---|---|---|---|
| 0165612 | 10/1982 | Japan | 123/90.39 |
| 2037888 | 7/1980 | United Kingdom | 123/90.39 |

*Primary Examiner*—E. Rollins Cross
*Assistant Examiner*—Weilun Lo
*Attorney, Agent, or Firm*—Gustalo Nunez

[57] ABSTRACT

A rocker arm assembly and support bridge assembly for use with internal combustion engines, having a base support and shaft bearing means for mounting a pair of oscillating rocker arms. A bridge support member spanning the pair of rocker arms and having bolt means for mounting the bridge support member to the base support, whereby said shaft bearing is disposed between said base support and said bridge support, said bolt means arranged on said support bridge assembly such that approximately one hundred percent of the force exerted by the bolt means is imposed on the shaft bearing member. Unique concave hold-down bolts are used to mount the base support to the cylinder head.

8 Claims, 3 Drawing Sheets

ROCKER ARM BRIDGE ASSEMBLY UTILIZING SHAFT MOUNT

BACKGROUND OF THE INVENTION

1. Field of the Invention.

The subject invention relates to a rocker arm assembly with an improved, stronger bridge support for mounting the rocker arm assembly onto the cylinder head of an internal combustion engine.

2. Description of the Prior Art.

Rocker arms are well known components of internal combustion engines and have been in existence for as long as internal combustion engines have been in existence. U.S. Pat. No. 4,674,453 discloses a rocker arm assembly directed to the type of rocker arm assembly which is stud mounted onto the engine assembly. The rocker arm assembly utilizes no support means other than the aforementioned stud which thus renders the rocker more susceptible to failure than the rocker arm assembly to be described below. The present invention utilizes base and bridge support means which results in a mechanically stronger and more reliable rocker arm assembly.

The present invention enhances the structural integrity of rocker arm assemblies of the type used in high performance engines such as those used in racing. As is well known, engines used in racing are subjected to extreme operating conditions which result in excessive forces and stresses being applied to the mechanical parts of the engine, in particular, to those parts which oscillate continuously. Among the many components of the engine which experience the forces and stresses under extreme operating conditions are the rocker arms.

The function of the rocker arm assembly is to control the opening and closing of the engine valves at the correct instant of the cycle. Every cylinder must have at least one intake valve and one exhaust valve. The intake valve permits the fuel mixture to enter the cylinder and be contained therein until combustion occurs, and the exhaust valve allows the burned gases to escape. The primary purpose of the rocker arm is to translate the upward movement of the pushrod into a downward movement of the valve spring which opens the valve. The downward movement of the pushrod results in the decompression of the valve spring which closes the valve.

Rocker arms may be mounted on a shaft or on a pivot point for oscillation about that point. Shaft mounted rocker arms oscillate on a common shaft. The rocker arms are lubricated by oil passages that route oil through the block, cylinder head, shaft and rocker arm. Some rocker arms are mounted on studs.

Rocker arms, which are used to transmit movement from the pushrods into an oscillating motion about a pivot point, which alternately results in the opening and closing of the engine intake and exhaust valves, are especially vulnerable to mechanical failure as a result of the stresses and forces which are imposed on them during high operating conditions. As mentioned in U.S. Pat. No. 4,674,453, when an engine is operating at peak RPM's, the pushrods may be subject to impact force variations of from zero to 1500 pounds at 5000 times per minute. In addition, the forces may be applied over a 20 to 30 degree arcuate variation in direction relative to the valve seat area.

SUMMARY OF THE INVENTION

This invention relates to a rocker arm assembly which is used to replace the normal stud mounted ball pivot or the stud mounted non-friction needle bearing type of roller rockers commonly used on V-8 pushrod type engines.

Prior replacement rocker arm assemblies have been accomplished by taking a simple block of metal with a shaft bolted into it and retained by a standard bolt in the original location of the formerly used stud which, in the majority of cases, is the only place to mount the assembly. The location of the bolt is directly under the rocker arm and, therefore, is the center of the unit loading. This type of replacement assembly places extreme operating loads on the bolt located directly under the rocker arm and thus, still renders the rocker arm susceptible to failure.

The instant invention spreads the forces throughout the entire rocker arm assembly. The structural assembly of the rocker arm base and bridge assembly and shaft mount directs the forces throughout the entire rocker arm support and shaft, thus enhancing the stability of the rocker arms at high unit loadings encountered at high RPM's, as is common in auto racing engines.

The subject invention includes a base support member which is mounted onto the cylinder head by means of two round head bolts, each having a concave head that, when tightened, contacts the perimeter of a counter sunk recess located on the base support which renders the connection rigid and immovable with respect to the cylinder head. The base support member is provided with a plurality of arcuate cutouts for receiving a shaft on which are rotatably mounted, a pair of rocker arm members. A bridge support member is fastened to the base support member, thereby securing the shaft between the base and bridge support member, with a plurality of bolts spaced about the bridge and base support members such that the forces exerted by the connecting bolts are imposed on the shaft. In this manner, the shaft is secured very rigidly to the base and bridge support members thereby enhancing the structural integrity of not only the shaft, but the rocker arms as well. The shaft will now wobble, which results in only upward and downward vertical movements by the rocker arms.

DETAILED DESCRIPTION OF THE PREFERRED EMBODIMENT

Figure 1:
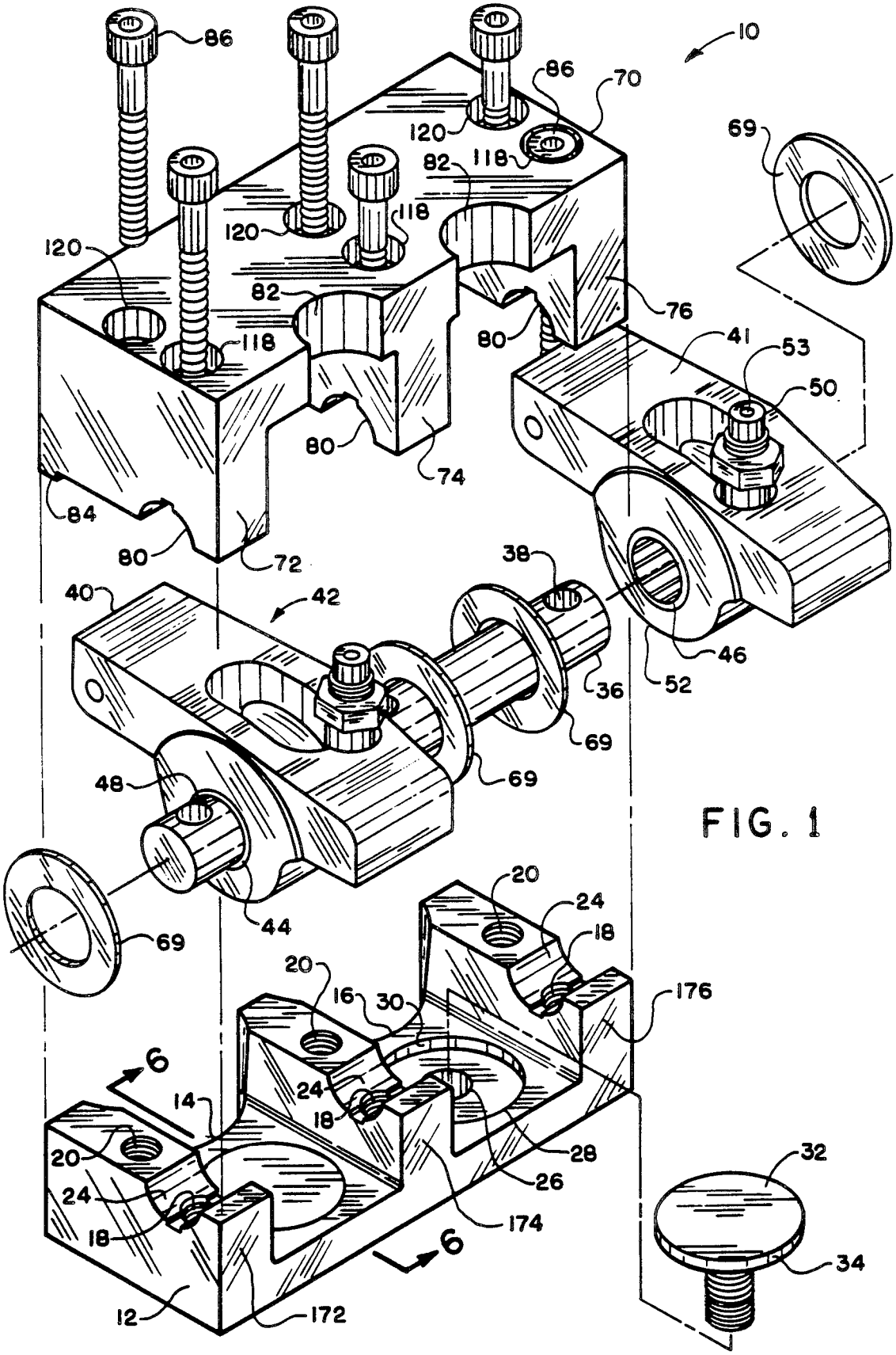
FIG. 1 is an exploded perspective view of the rocker arm assembly with base and bridge support in accordance with the subject invention.

Referring more particularly to the drawings for the purpose of illustrating a preferred embodiment of the invention only, and not for the purpose of limiting same, FIG. 1 shows the entire rocker arm assembly with base and bridge support members shown generally by the reference numeral 10.

The base support member 12 is shown as a generally elongated rectangular block with a pair of arcuate cutouts at 14 and 16. The base support member 12 is provided with a plurality of threaded apertures 18 and 20, six in the embodiment shown. The base support member is further provided with a plurality of upwardly extending towers 172, 174, and 176. Arcuate tower cutouts 24 are at one end of each of the towers 172, 174 and 176. Apertures 18 are positioned generally in the center most position of the arcuate cutouts 24. Interposed between towers 172 and 174, and 174 and 176 are apertures 26 which are centrally located in a circular recess 28. The sides 30 of the circular recess tend to be convex in configuration. A round head threaded bolt 32 in which the side surfaces 34 of the round head are concave in configuration and are designed to fit within the circular recess 28 when inserted through the aperture 26. The round head bolts 32 are used to mount the base support 12 to the cylinder head of an engine.

Also shown in FIG. 1 is a shaft 36 including a plurality of apertures 38. The shaft 36 is designed to seat in the arcuate cutouts 24 which are found on the towers 172, 174 and 176.

Figure 2:
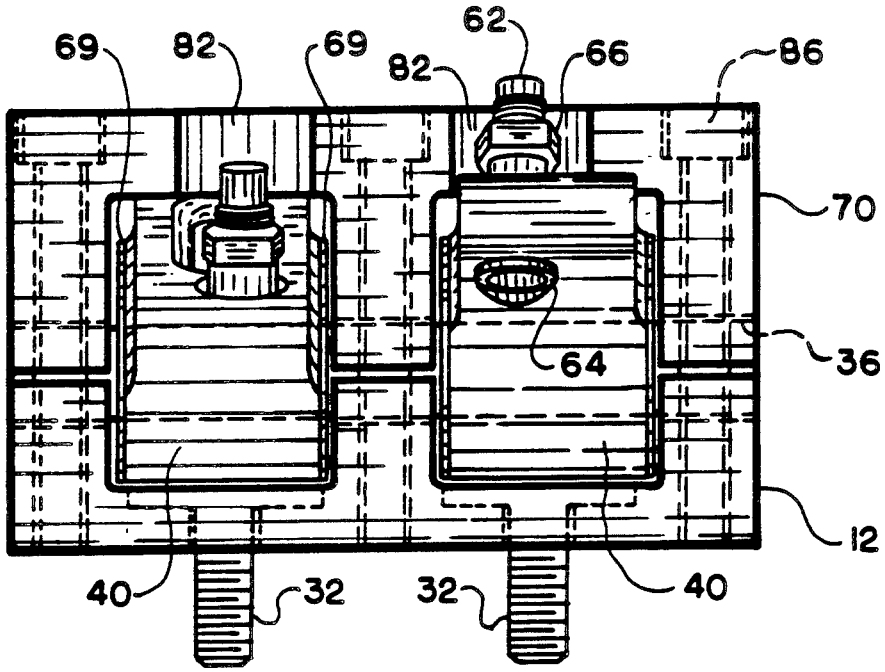
FIG. 2 is a front view, partially in cross section, of the rocker arm assembly with bridge and base supports and showing the push rods.
Figure 3:
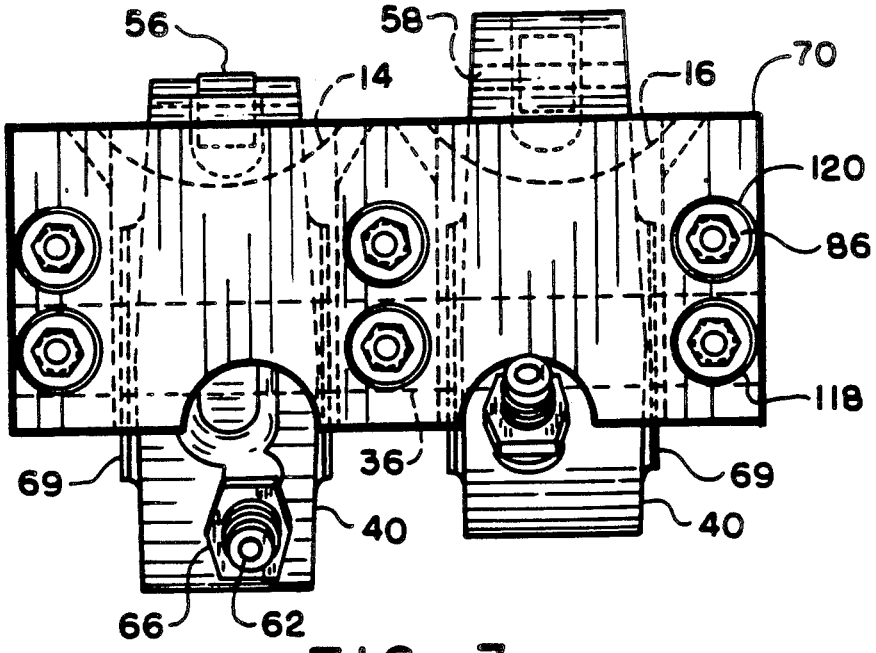
FIG. 3 is a top view, partially in cross section of the invention.
Figure 4:
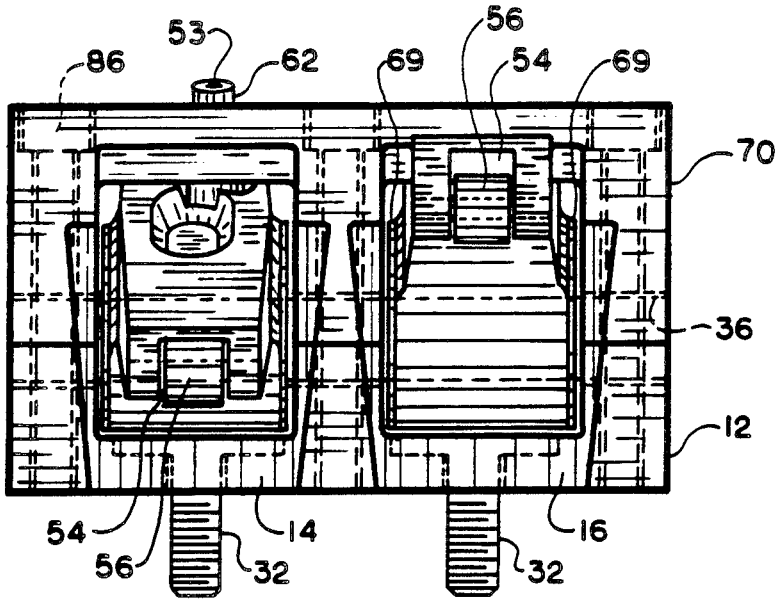
FIG. 4 is another back view, partially in cross section, showing the roller members.
Figure 5:
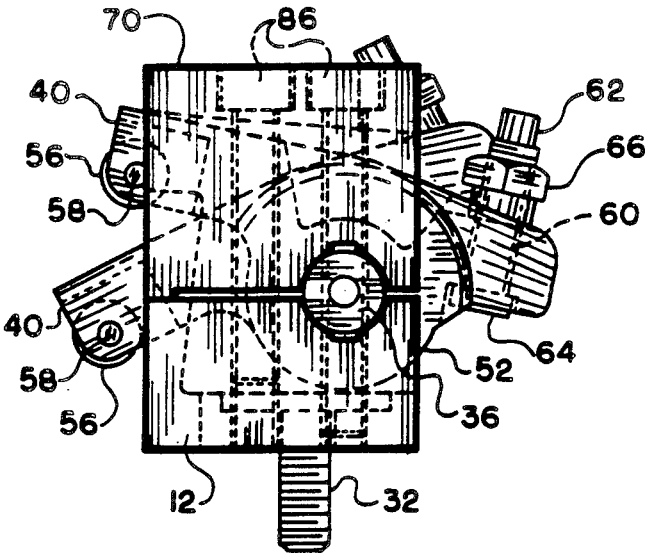
FIG. 5 is a side view, partially in cross section, of the invention showing the shaft which is interposed between the top bridge support and bottom base support.
Figure 6:
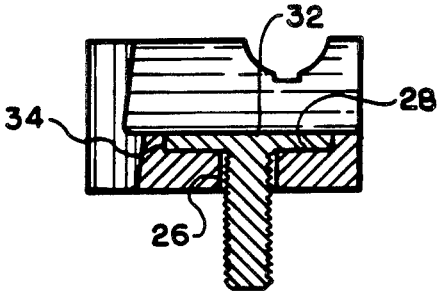
FIG. 6 is a cross sectional view of the round head screw.

Referring now to FIGS. 1, 2 and 3, a pair of identical rocker arms 40 and 41 can be seen to be slideably mounted on shaft 36. In many respects, rocker arms 40 and 41 are similar to those disclosed in U.S. Pat. No. 4,674,453. The rocker arms 40 and 41 are shown as comprising an elongated body 42 which includes a pair of spaced needle members 44 and 46 which are press fitted into each of the rocker arms 40 and 41, thereby defining a shaft opening 48 which is transverse to the longitudinal axis of the rocker arms 40 and 41.

As mentioned previously, the rocker arms 40 and 41 are an elongated body being somewhat arcuate in configuration 50 on the top outside surface above the shaft opening 48 and having an arcuately shaped outside bottom surface 52 below the shaft opening 48.

Located at one end of each of the rocker arms 40 and 41 is a recess 54 in which is rotatably secured a roller member 56 which is held in place by a shaft 58, said shaft 58 being transverse to the longitudinal axis of rocker arms 40 and 41. Located at the other end of the rocker arms 40 and 41 is opening 60 which is positioned somewhat off center of the elongated body 42, the center being defined by the longitudinal axis of the elongated body 42. Further, the opening 60 on rocker arms 40 and 41 is located generally adjacent the central most tower 174. Threadedly secured in the recess 60 is a pushrod seat 62 having a pushrod recess 64 at the lower end thereof and a locking nut 66 at the upper end thereof. The locking nut 66 is used for adjusting the pushrod seat 62 with respect to a pushrod (not shown) extending from the cam. The pushrod seat 62 is a copper plated steel bolt having a lubricating opening 68 through its entire length. The openings 60 on each of the rocker arms 40 and 41 are both located off center, as mentioned previously, and adjacent the central most tower 174. The base support 12 is secured to the cylinder head by means of the round head bolts 32. One type of bolt head that has been found to work well is one having a pair of spanner holes on the top surface thereby requiring a spanner wrench to tighten the bolt 32 in place.

The rocker arms 40 and 41 are inserted into recesses defined by the towers 172, 174 and 176 such that the rocker arms transverse openings 48 are in alignment with the arcuate tower cutouts 24. Washers 69 are interposed between the tower surfaces and the rocker arms 40 and 41. The shaft 36 is inserted through the transverse openings 48 found on the rocker arms 40 and 41 and positioned in the arcuate tower cutouts 24.

A bridge support member 70 is shown in FIG. 1. Bridge support member 70 includes towers 72, 74 and 76, having spacing identical to the spacing found on the base support towers 172, 174 and 176. Each of the towers has apertures 118 and 120 located thereon, said apertures being identically positioned such that when the bridge support member is positioned over the base support 12, the bridge support member apertures 118 and 120 are in alignment with the base support member threaded apertures 18 and 20. The towers 72, 74 and 76 are all provided with circular cutouts 80 and arcuately shaped cutouts 82 on the top of the bridge support surface. The towers 72, 74 and 76 are also provided with shoulders 84 at the side opposite the arcuate cutouts 80. The bridge support 70 is mounted on the base support 12 such that the arcuately shaped cutouts face the push rod seat 62 and lock nut 66. The bridge support 70 is secured to the base support 12 by a plurality of socket head cap screws 86. As can be seen from FIG. 1, the apertures 18 and 20, 118 and 120 are positioned such that they are directly in alignment with the apertures 38 found on the shaft 36. As can be seen from FIG. 1, the screws 86 are somewhat offset from the center of the rocker arms 40 and 41, and positioned such that bolts 86 are inserted through the shaft 36, and also immediately adjacent said screws 86. The tightening of the screws 86 in combination with the shoulder 84 directs the holding forces of the screws 86 to be directed to the shaft 36 which thereby strengthens the shaft 36.

In operation, reciprocating motion is applied to the rocker arms 40 and 41 by the movement of pushrods emanating from the engine. This causes oscillating movement of the rocker arms 40 and 41 about the shaft 36. This motion is then transmitted to the valve stem spring (not shown) through the roller member 56 which results in valve closings and valve openings.

The rocker arm assembly 10 just described provides a structure in which the rocker arms 40 and 41 can withstand substantial force and impact loading as a result of the base support 12 and bridge support 70 in combination with the shaft 36. As a result of the enhanced structural integrity, the invention provides increased RPM ranges, increased horsepower, less valve bounce which further increases the horsepower, longer valve spring service life, longer valve service life, increased valve lifter service life, better valve sealing as a result of less valve bounce and an over all increase in valve train efficiency.

Some of the representative materials which can be used to fabricate the invention are:

a) nickle chromium alloy for shaft 36
b) carbon steel for the base support 12
c) aluminum for the bridge support 70 and rocker arms 40 and 41.

The rocker arm assembly as shown in FIG. 1, discloses an assembly having two rocker arms 40 and 41 which are designed to oscillate about a pivot point established by the shaft 36. As mentioned previously, a pushrod extending upwardly from the engine is engaged by the pushrod seat 64. A valve spring (not shown) is in engagement with the roller member 56. In most combustion engines, the combustion cylinder is provided with an exhaust opening and an intake opening. The openings are held closed by the valve spring until such time that the valve spring is compressed by the roller member 56. The vertical reciprocation of the pushrod emanating from a cam is transmitted to the rocker arms 40 and 41 by the pushrod engaging the pushrod seat 64 and causes the rocker arm to rotate about the shaft 36. As the rotation goes through its cycle, the rocker arm roller 56 compresses the valve spring which opens the valve. The movement of the pushrods results in the rocker arms 40 and 41 oscillating about the shaft 36. It can be seen that the rocker arm assembly 10 sustains an immense punishment at high operating speeds. Therefore, it is important that the structural integrity be of the highest level.

It is understood that the form of the invention herewith shown and described is to be taken as a preferred example of the same and that it will be apparent to those of ordinary skill in the art, upon reading this disclosure, that other modifications and variations can be made. Accordingly, reference should be made to the appended claims for determining the full and complete scope of the present invention.

What I claim:

1. A rocker arm assembly in combination with an internal combustion engine comprising:

a) a plurality of rocker arm members, each having a longitudinal extent and including bearing means for mounting said rocker arm members for oscillation about an axis which extends generally transversely of said longitudinal extent;

b) an elongated shaft member, mounted within said bearing means, said shaft member defining said axis of oscillation;

c) a base support member adapted to receive said shaft member and said rocker arms, said base support member defining a forward edge;

d) a bridge support member fixedly mounted on said base support member, said shaft member interposed between said base member and said bridge member;

e) said base support member and said bridge member each include three towers extending upwardly and downwardly respectively, and tower members further including means for receiving engaging connectors.

2. The assembly as defined in claim 1 wherein each tower member includes two elongated recesses wherein the recesses provided on the base support member are threaded, said recesses on said base support member being in longitudinal alignment with the recesses provided on said bridge member.

3. The assembly as defined in claim 2 wherein said elongated shaft member includes a plurality of apertures, said apertures being in longitudinal alignment with the forward recesses provided on said base support member and said bridge support member.

4. The assembly as defined in claim 3 including concave round headed connectors for securing said base support member to an engine component.

5. The assembly as described in claim 4 wherein said rocker arms includes a roller member at one end thereof for engaging valve cylinder springs and at another end thereof, pushrod recesses for engaging cam operated pushrods.

6. The assembly as described in claim 5 wherein said bridge support tower members further including shoulders at one end thereof, said shoulder directing the forces, developed by the connector means of claim 5, towards and upon the shaft member.

7. A rocker arm assembly comprising:

a) an elongated generally rectangular base support member including a plurality of upwardly extending tower members, defining a recess therebetween, said recess provided with means for attaching said base support member to an engine component, said base support tower members being provided with a plurality of threaded apertures and being further provided with an arcuate recess, each said arcuate recess being in alignment with each other and being generally parallel to a longitudinal axis defined by said elongated base support member;

b) a plurality of rocker arms, having a longitudinal extent and defining a longitudinal axis, said rocker arm further including a roller member at one end thereof, a pushrod seat at the other end thereof and a bearing member transverse to the longitudinal axis of said rocker arm;

c) a shaft member including a plurality of spaced apertures therethrough, said spacing being generally identical to the distances between said threaded apertures;

d) an elongated generally rectangular bridge support member including a plurality of downwardly extending tower members generally mirroring the upwardly extending tower members of said base support member, and further including a plurality of apertures generally imaging the plurality of threaded apertures provided on said upwardly extending tower members of said base support member, said downwardly extending tower members each being further provided with arcuate recess, all being generally parallel to the longitudinal axis defined by said base support member;

e) said rocker arms being disposed in the recesses defined by said upwardly extending tower members of said base support member, said shaft member being disposed through said bearing member and mounted in said arcuate recesses of said upwardly extending tower members;

f) said bridge support member mounted on said base support member, said arcuate recesses provided on said bridge support member being immediately adjacent said shaft;

g) threaded connector means for connecting said bridge member to said base member, said threaded connector means being inserted through said apertures on said bridge support member for threaded engagement with said threaded apertures provided on said base member;

h) reciprocating means for inducing an oscillating motion to said rocker arms about a pivot point defined by said shaft member.

8. A rocker are assembly for use with an internal combustion engine having cam operated pushrods and valve springs, comprising:

a) two rocker arm members, each having a longitudinal extent and including bearing means, said bearing means being transverse to the longitudinal extent thereof, said bearing means permitting oscillation of said rocker arm members about an axis defined by said bearing means;

b) a base support member provided with three upwardly extending towers each tower defining a forward edge, rearward edge, top surface and bottom surface, said base support member further provided with at least two threaded apertures positioned towards said forward edge and being further provided with an arcuate cutout on each of the top surfaces of said upwardly extending towers, said arcuate cutouts being in alignment with each other, and positioned towards said forward edge;

c) said rocker arms being positioned between said upwardly extending towers of said base support, said bearing means being in longitudinal alignment with said arcuate cutouts provided on said base support member;

d) a shaft member mounted in said bearing means and adapted to be positioned within said arcuate cutouts on said base support tower member;

e) a bridge support member provided with three downwardly extending towers, each tower defining a forward edge, a rearward edge, top surface and bottom surface, said bridge support member further provided with at least two apertures positioned towards said forward edge and each being further provided an arcuate cutout on each of the bottom surfaces of said downwardly extending towers, said arcuate cutout being in alignment with each other and in alignment with said arcuate cutouts provided on said base support member;

f) threaded connector means for securing said bridge support member to said base support member, said threaded connectors being inserted through said two apertures on said bridge member for threaded engagement with the two threaded apertures provided on said base member;

g) means for inducing an oscillating motion to said rocker arm, said rocker arm oscillating about a pivot point defined by said shaft.

* * * * *